US011732587B2

(12) United States Patent
Sjöström et al.

(10) Patent No.: US 11,732,587 B2
(45) Date of Patent: Aug. 22, 2023

(54) BLADE ELEMENT

(71) Applicant: Valmet Technologies Oy, Espoo (FI)

(72) Inventors: Håkan Sjöström, Valkeakoski (FI); Tuomas Himanka, Valkeakoski (FI)

(73) Assignee: VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/732,103

(22) Filed: Apr. 28, 2022

(65) Prior Publication Data

US 2022/0349309 A1 Nov. 3, 2022

(30) Foreign Application Priority Data

Apr. 29, 2021 (FI) ..... 20215500

(51) Int. Cl.

| | |
|---|---|
| ***D21D 1/22*** | (2006.01) |
| ***F01D 5/14*** | (2006.01) |
| ***F01D 5/02*** | (2006.01) |
| ***F01D 9/02*** | (2006.01) |
| ***D21D 1/30*** | (2006.01) |

(52) U.S. Cl.

CPC ..... *F01D 5/14* (2013.01); *D21D 1/22* (2013.01); *D21D 1/306* (2013.01); *F01D 5/02* (2013.01); *F01D 9/02* (2013.01); *F05D 2240/30* (2013.01)

(58) Field of Classification Search

CPC .. B02C 2/00; B02C 2/005; B02C 7/12; D21D 1/22; D21D 1/306

See application file for complete search history.

(56) References Cited

U.S. PATENT DOCUMENTS

| | | | | |
|---|---|---|---|---|
| 9,085,850 | B2 * | 7/2015 | Gingras | D21D 1/306 |
| 9,133,579 | B2 * | 9/2015 | Sjostrom | D21D 1/30 |
| 9,968,938 | B2 * | 5/2018 | Gingras | B02C 7/12 |
| 10,464,068 | B2 | 11/2019 | Sjöström et al. | |
| 11,142,869 | B2 | 10/2021 | Sjöström et al. | |
| 2014/0091163 | A1 * | 4/2014 | Ek | D21D 1/306 241/298 |
| 2021/0017706 | A1 * | 1/2021 | Lindblom | D21D 1/306 |

* cited by examiner

*Primary Examiner* — Courtney D Heinle
*Assistant Examiner* — Danielle M. Christensen
(74) *Attorney, Agent, or Firm* — Stiennon & Stiennon

(57) ABSTRACT

A blade element (4, 8) for a comminution device (1) to comminute fiber material has at least one comminution section (22) with comminution parts (20, 24, 25, 26) and free spaces (21) therebetween, and at least one feed section (23) extending at least partly in a longitudinal direction (X) of the blade element (4, 8), each feed section (23) intended to feed fiber material to the respective comminution section (22). The comminution parts have a first dimension (d20*a*, d20*b*, d20*c*, d24*a*, d24*b*, d24*c*) extending in a circumferential direction (C) of the blade element and a second dimension (e20*a*, e20*b*, e20*c*, e24*a*, e25*a*, e26*a*) extending in the longitudinal direction (X) of the blade element. At the same longitudinal (X) position in the blade element (4, 8) the first dimension of the comminution parts is arranged to increase in the circumferential direction (C) of the blade element toward the feed section.

20 Claims, 4 Drawing Sheets

BLADE ELEMENT

CROSS REFERENCES TO RELATED APPLICATIONS

This application claims priority on Finnish App. No. FI20215500, filed Apr. 29, 2021, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a comminution device to comminute fiber material. Especially the invention relates to a blade element for the comminution device to comminute fiber material.

Refiners for refining fiber material and dispersers for dispersing fiber material are comminution devices to comminute fiber material. The material is comminuted between two opposite comminution elements at least one of which is rotating. A blade element applicable with the said comminution devices comprises a refining i.e., a comminution surface to comminute the fiber material, wherein the comminution surface comprises at least one comminution section comprising comminution parts (blade bars) and free spaces (grooves) therebetween, and at least one feed section extending at least partly in a direction of a longitudinal axis of the blade element for feeding fiber material to the at least one comminution section.

A problem with that kind of a blade element is an increased wear rate of especially those comminution parts that lie next to the feed section and first meet the fiber material fed into the feed section. In a rotatable comminution element those comminution parts which wear more are on that side of the comminution section that face in the rotation direction of the rotatable comminution element, and in the stationary comminution element, consequently, wear on that side of the comminution section that faces in the opposite direction relative to the rotation direction of the rotatable comminution element. The increased wear rate of the said comminution parts is caused by a strong turbulent flow of the fiber containing material over the comminution parts lying close to the feed section. This increased wear is especially visible as wear of the comminution part top surfaces and as rounding of edges of the comminution part and decreases an operation efficiency of the blade element.

SUMMARY OF THE INVENTION

An object of the present invention is to provide a novel blade element for a comminution device to comminute fiber material, as well as a novel comminution device to comminute fiber material.

The novel blade element has a feed section or area which extends along a side of the blade element and the feed section is wide at the inner edge of the blade element and narrows toward the outer edge of the blade element. The comminution parts or blade bars are arranged at an acute angle to a radial line from the inner edge to the outer edge and the comminution parts or blade bars, are wider as blade bars are arranged closer to the outer edge and there may be free spaces or grooves between bars of a constant width.

The invention is based on the idea of increasing a strength and wear resistance of the blade element close to the feed section of the blade element.

An advantage of the solution is a prolonged operational life of the comminution parts of the blade element next or close to the feed section, whereby satisfactory operational characteristics of the comminution surface of the blade segment may be maintained longer.

BRIEF DESCRIPTION OF THE DRAWINGS

In the following the invention will be described in greater detail by means of preferred embodiments with reference to the accompanying drawings.

For the sake of clarity, the figures show some embodiments of the invention in a simplified manner. Like reference numerals identify like elements in the figures.

DESCRIPTION OF THE PREFERRED EMBODIMENTS

Figure 1:
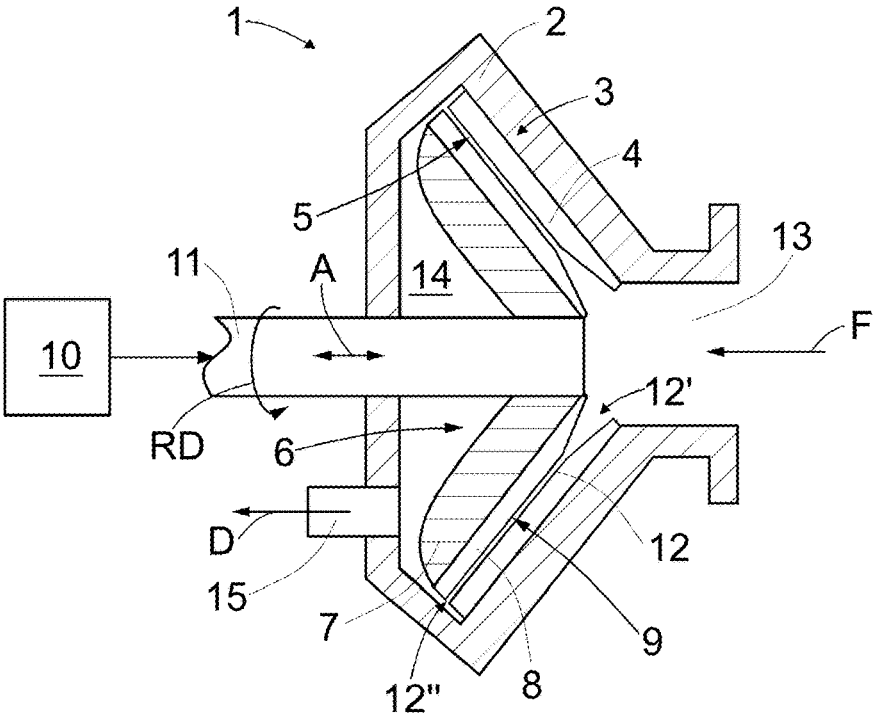
FIG. 1 is a schematic side view of a conical comminution device in cross-section.

FIG. 1 shows schematically a side view of a conical comminution device 1 in cross-section, which comminution device may be used to comminute a fiber material, such as a wood material containing lignocellulose or another fiber material suitable to be used for manufacturing paper or paperboard, for example. The comminution device 1 shown in FIG. 1 is of conical type with conical-shaped comminution elements but comminution devices with disc-shaped, conical-disc-shaped or cylindrical-shaped comminution elements could be used as well as an example here. Generally, the comminution device comprises at least two substantially oppositely positioned comminution elements at least one of which is rotating, and a comminution gap formed between each two substantially oppositely positioned comminution elements. In the following a comminution device with only one rotatable comminution element is described.

The comminution device 1 of FIG. 1 comprises a frame 2 and a stationary, fixed comminution element 3, i.e., a stator 3, supported on the frame 2. The frame 2 provides a body for the stator 3 unless the stator 3 is provided with a separate body to be fastened to the frame 2 of the comminution device 1.

The stator 3 comprises one or more stator blade elements 4 comprising comminution parts and free spaces or interstices therebetween. The comminution parts are protrusions that protrude from a substrate of the respective blade element and are arranged to subject a comminution effect to the fiber material to be processed, i.e., to the fiber material to be comminuted. The free spaces adjacent to or between the comminution parts provide flow channels for the flow of the fiber material along the blade element 4. The comminution parts and the free spaces in each one or more stator blade elements 4 form a comminution surface 5 of the respective blade element 4. A complete comminution surface of the stator 3 is formed either of the comminution surface 5 of a single stator blade element 4 extending over the whole circumference of the stator 3 or, more commonly, of the comminution surfaces 5 of two or more blade elements 4 having a form of a blade segment and fastened next to each other in the stator 3 so that the complete comminution surface 5 extending over the whole circumference of the stator 3 is provided. In the latter case the comminution surface 5 of each stator blade segment 4 provides only a part of the complete comminution surface of the stator 3. For the sake of clarity, both the comminution surface of each one or more stator blade elements 4 as well as the complete comminution surface of the stator 3 are herein denoted with the same reference sign 5. Additionally, the same reference sign 4 may be used to denote a segment-like blade element for the stator 3 as well as a single blade element extending over the whole circumference of the stator 3.

The comminution device 1 further comprises a rotatable comminution element 6, i.e., a rotor 6 of the comminution device 1. The rotor 6 comprises a hub 7. The rotor 6 further comprises one or more rotor blade elements 8 supported to the hub 7, each one or more rotor blade elements 8 comprising comminution parts and free spaces or interstices therebetween. The comminution parts and free spaces in each one or more rotor blade elements 8 form a comminution surface 9 of the respective blade element 8. A complete comminution surface of the rotor 6 is formed either of the comminution surface 9 of a single rotor blade element 8 extending over the whole circumference of the rotor 6 or, more commonly, of the comminution surfaces 9 of two or more blade elements 8 having a form of a blade segment and fastened next to each other in the rotor 6 so that the complete comminution surface 9 extending over the whole circumference of the rotor 6 is provided. In the latter case the comminution surface 9 of each rotor blade segment 8 provides only a part of the comminution surface of the rotor 6. For the sake of clarity, both the comminution surface of each one or more rotor blade elements 8 as well as the complete comminution surface of the rotor 6 are herein denoted with the same reference sign 9. Additionally, the same reference sign 8 may be used below to denote a segment-like blade element for the rotor 6 as well as a single blade element extending over the whole circumference of the rotor 6.

The hub 7 of the rotor 6 is connected to a driving motor 10 by a shaft 11 so that the rotor 6 can be rotated relative to the stator 3 in a direction of arrow RD, for instance, the arrow RD thus indicating an intended rotation direction RD of the rotor 6.

The comminution device 1 may also comprise a loading device which, for the sake of clarity, is not shown in FIG. 1. The loading device can be used for moving back and forth the rotor 6 attached to the shaft 11, as schematically shown by arrow A, to adjust a size of a comminution gap 12, i.e., a comminution chamber 12, between the stator 3 and the rotor 6, wherein the fiber material is processed. A structure and operation of different applicable loading devices are generally known for a person skilled in the art and are therefore not disclosed herein in more detail.

The fiber material to be processed is fed into the comminution device 1 in a form of a fiber pulp being a mixture comprising water and fiber material, typically having a consistency of 3-40% via a feed channel 13 in a manner shown by arrow F. The fiber material fed into the comminution device 1 passes into the comminution gap 12 through a first end 12' or a feed end 12' of the comminution gap 12 having the smaller diameter. In the comminution gap 12 the fiber material is processed while the water contained in the material may vaporize. The already processed, i.e., comminuted, fiber material flows away from the comminution gap 12 through a second end 12" or a discharge end 12" of the comminution gap 12 having a larger diameter into a discharge chamber 14. From the discharge chamber 14 the processed material is removed via a discharge channel 15 from the comminution device 1, as schematically shown by arrow D.

It is emphasized that in addition to the conical comminution devices the blade element of the solution described herein is applicable to disc-type and cylindrical-type comminution devices and to comminution devices comprising both a conical portion and a disc portion, as well.

According to an embodiment the comminution device 1 is a refiner for refining fiber material, whereby the fiber material may be a virgin fiber material or recycled fiber material. In refining a refining effect is subjected to the fiber material to be processed for affecting on fiber properties of the fiber material. When the comminution device 1 is a refiner, the comminution elements 3, 6, i.e., the stator 3 and the rotor 6, are implemented as refining elements of the refiner, and the comminution surfaces 5, 9 of the comminution elements 3, 6 are implemented as refining surfaces of the refining elements and the refining surfaces of the blade elements in the refining elements. The refining surfaces of the refining elements/blade elements comprise blade bars and blade grooves therebetween. The blade bars form in the refining surface the comminution parts arranged to subject a refining effect to the fiber material to be processed. The blade bars are typically longitudinal ridges with straight, curved or in otherwise shaped substantially continuous structure in their longitudinal direction, and the length of each blade bar is typically substantially greater than its width. The blade grooves are free spaces or interstices remaining between the blade bars for providing between the blade bars flow channels for the flow of the fiber material along the refining surfaces. The shape of the blade groove in its longitudinal direction follows the longitudinal structure or shape of the adjacent blade bars. The length of each blade groove is therefore also typically substantially greater than its width.

Figure 2:
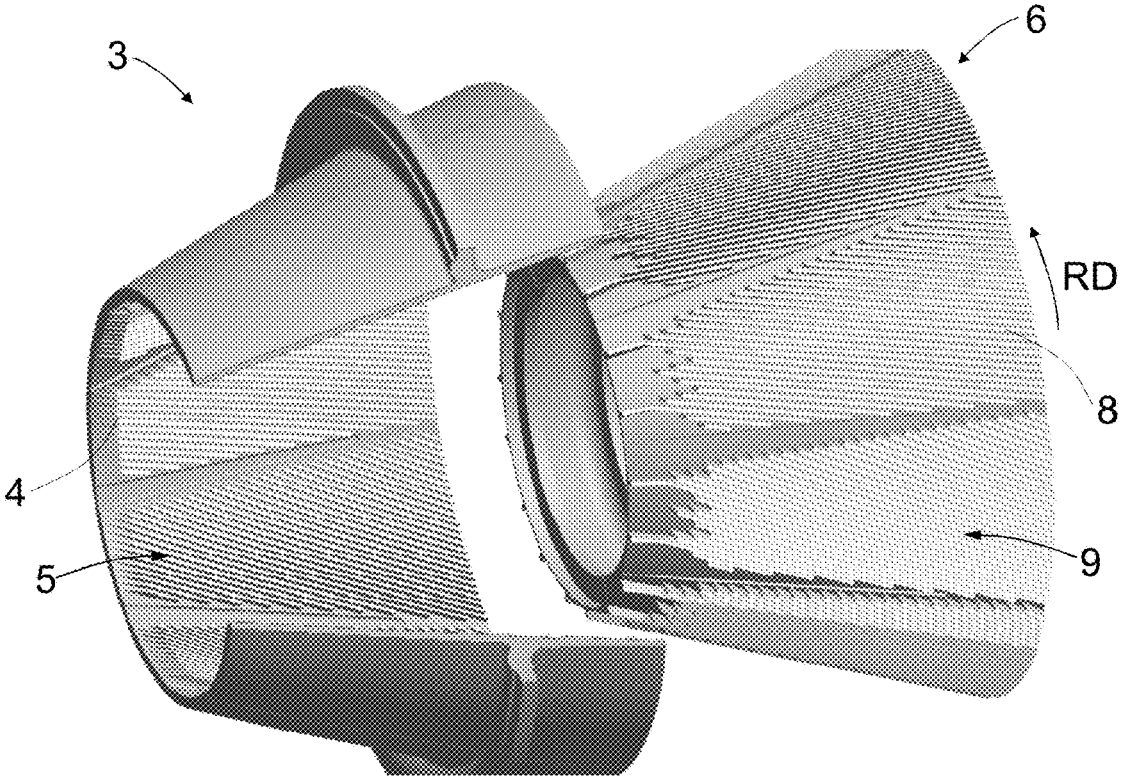
FIG. 2 is a schematic partly cross-sectional side perspective view of a stator and a rotor of a refiner.

FIG. 2 is a schematic partly cross-sectional side view of a stator 3 and a rotor 6 of a comminution device 1 being implemented as a conical refiner. In FIG. 2, for the sake of clarity, the rotor 6 is moved to a non-operative position relative to the stator 3. The stator 3 comprises a number of blade segments 4 fastened next to each other in the circumferential direction of the stator 3, the blade segments 4 comprising blade bars and blade grooves that form the refining surfaces 5 of the respective blade segments 4. Similarly, the rotor 6 comprises a number of blade segments 8 fastened next to each other in the circumferential direction of the rotor 6, the blade segments 8 comprising blade bars and blade grooves that form the refining surfaces 9 of the respective blade segments 8. For the sake of clarity, the hub of the rotor 6 is omitted in FIG. 2. The intended rotation direction RD of the rotor 6 is also shown schematically in FIG. 2.

Figure 3:
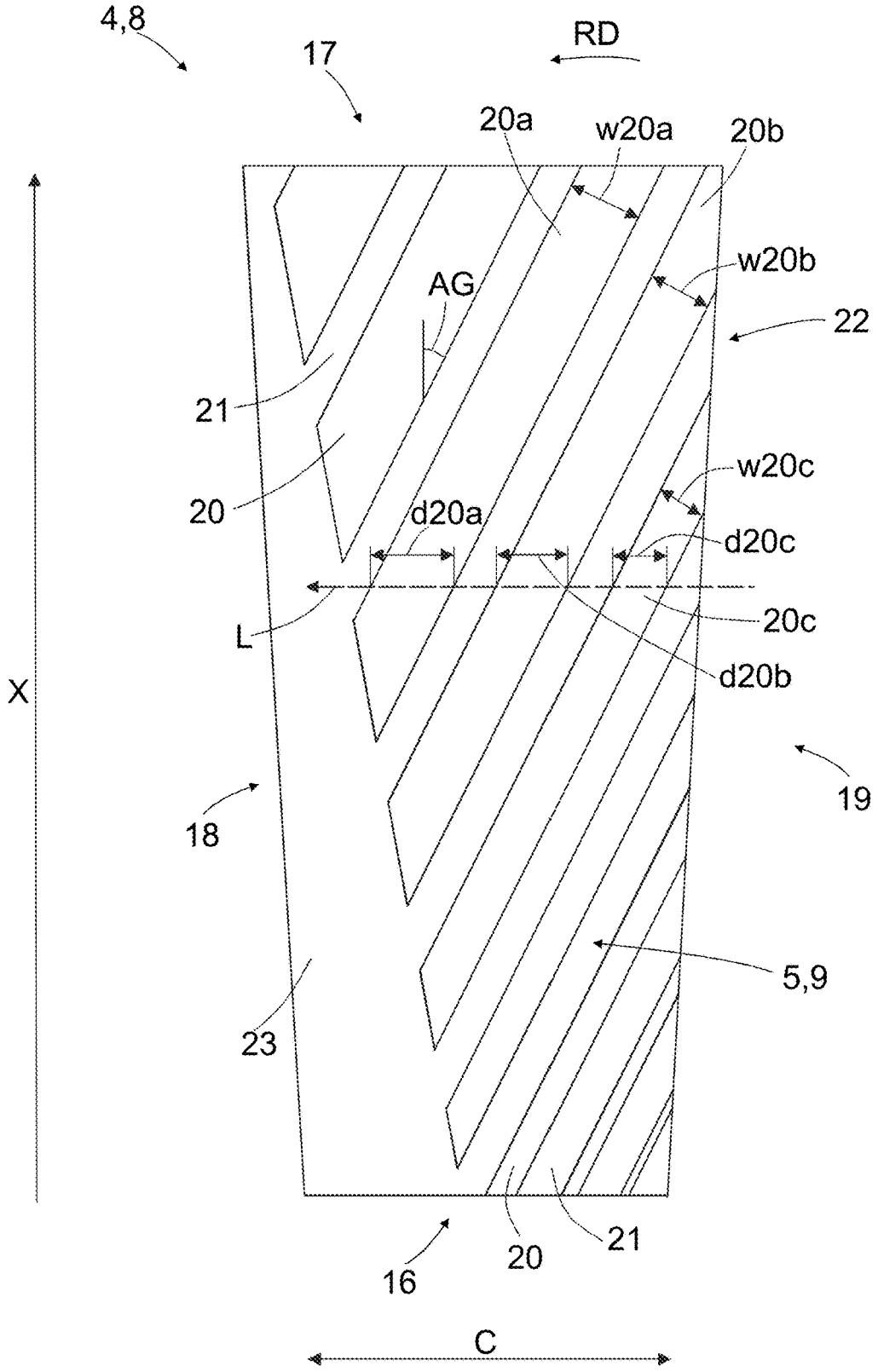
FIGS. 3 and 4 are schematic planar top views of a blade element of a refiner.

FIG. 3 is a highly schematic planar top view of a blade segment 4, 8 applicable to form a part of a stator 3 or a rotor 6 in a refiner of FIG. 2. The blade segment 4, 8 comprises an inner end edge 16 or a first end edge 16 or a feed end edge 16 to be directed toward the first end 12' of the refiner, i.e., toward the end of the stator 3 or rotor 6 having the smaller diameter. The fiber material to be refined is fed or supplied onto the refining surface 5, 9 of the blade segment 4, 8 over the first end edge 16.

The blade segment 4, 8 further comprises an outer end edge 17 or a second end edge 17 or a discharge end edge 17 to be directed toward the second end 12" of the refiner, i.e., toward the end of the stator 3 or rotor 6 having the larger diameter. The refined fiber material is discharged from the refining surface 5, 9 over the second end edge 17.

A longitudinal direction of the blade segment 4, 8 or a longitudinal axis of the blade segment 4, 8 extends between the inner end edge 16 and the outer end edge 17 of the blade segment 4, 8. The longitudinal direction or the longitudinal axis of the blade segment 4, 8 is denoted schematically in FIG. 3 with the arrow X shown, for the sake of clarity, on the left side of the blade segment 4, 8. The longitudinal axis X of the blade segment 4, 8 also implies for a blade segment intended to a conical or a cylindrical comminution device an axial direction of the blade segment and for a blade segment intended to a disc-type comminution device a radial direction of the blade segment. The direction of the blade segment 4, 8 perpendicular to the longitudinal axis X of the blade segment 4, 8 is a circumferential direction or a transverse axis of the blade segment 4, 8. The circumferential direction or the Transverse axis is denoted schematically in FIG. 3 with the arrow C shown, for the sake of clarity, below the blade segment 4, 8.

The blade segment 4, 8 further comprises a first side edge 18 or a leading side edge 18 extending from the inner end edge 16 of the blade segment 4, 8 up to the outer end edge 17 of the blade segment 4, 8. The first side edge 18 is the edge of the blade segment 4, 8 that first meets the edge of a counter blade segment in an oppositely positioned refining element (stator/rotor) during the rotation of the rotor 6. So, in the rotor 6 it provides the side edge of the blade segment 8 to be directed to the intended rotation direction RD of the rotor 6 and in the stator 3 it provides the side edge of the blade segment 4 to be directed to the opposite direction relative to the intended rotation direction RD of the rotor 6.

The blade segment 4, 8 further comprises a second side edge 19 or a trailing side edge 19 opposite to the first side edge 18 in the circumferential direction C of the blade segment 4, 8, the second side edge 19 extending from the inner end edge 16 of the blade segment 4, 8 up to the outer end edge 17 of the blade segment 4, 8. The second side edge 19 is thus, in turn, the edge of the blade segment 4, 8 that last meets the edge of a counter blade segment in an oppositely positioned refining element (stator/rotor) during the rotation of the rotor 6. So, in the rotor 6 it provides the side edge of the blade segment 8 to be directed to the opposite direction relative to the intended rotation direction RD of the rotor 6 and in the stator 3 it provides the side edge to be directed to the same direction with the intended rotation direction RD of the rotor 6. In the embodiment of FIG. 2 the first 18 and second 19 side edges are straight, but they could also be curved as well.

The leading edge and the trailing edge are easily recognized by a person skilled in the art from the bar/groove pattern and especially bar inclination. The blade bars 20 are always so inclined that they rise from the inner end edge and the leading side edge toward the outer end edge and the trailing side edge to ensure proper flow of the fiber material from the feed edge to the discharge edge.

The blade segment 4, 8 comprises the refining surface 5, 9 comprising blade bars 20 and blade grooves 21, the blade bars 20 and the blade grooves 21 having a first dimension in the circumferential direction C of the blade segment 4, 8 and a second dimension in the longitudinal direction X, or the axial or radial direction X, of the blade segment 4, 8. The first dimension of the blade bars 20 is thus a circumferential dimension of the blade bars 20 along the transverse axis C of the blade segment 4, 8, and the second dimension of the blade bars 20 is thus an axial or radial dimension of the blade bars 20 along the longitudinal axis X of the blade segment 4, 8. A section of the refining surface 5, 9 of the blade segment 4, 8 comprising the blade bars 20 and the blade grooves 21 forms a refining section 22, i.e., a comminution section 22, of the blade segment 4, 8. The section of the refining surface 5, 9 of the blade segment 4, 8 being substantially free from the blade bars 20 forms a feed section 23 of the blade segment 4, 8. The feed section 23 extends from the inner end edge 16 of the blade segment 4, 8 toward an outer end edge 17 of the blade segment 4, 8, and may extend up to the outer end edge 17 as schematically shown in FIG. 3. The fiber material to be refined enters to the feed section 23 over the inner end edge 16 of the blade segment 4, 8 and further flows from the feed section 23 to the refining section 22 in response to the rotation of the rotor 6. A single blade segment 4, 8 may comprise one or more refining sections 22 and one or more feed sections 23.

For resisting excessive wear of the blade bars 20 especially at a position next or close to the feed section 23 so as to prolong an operating life of the blade segment 4, 8 with a satisfactory operational efficiency. FIG. 3 shows an embodiment, wherein at the same longitudinal position in the blade segment 4, 8, i.e., at the same position in the blade segment 4, 8, in the longitudinal direction of the blade segment 4, 8, the first dimension of the blade bars 20 in the circumferential direction of the blade segment 4, 8, is arranged to be larger in the blade bars 20 lying closer to the feed section 23 than in the blade bars 20 remaining farther away from the feed section 23 in the circumferential direction of the blade segment 4, 8.

FIG. 3 shows schematically a dashed reference line L running in the circumferential direction of the blade segment 4, 8 at a specific longitudinal position in the blade segment 4, 8 from the inner end edge 16 of the blade segment 4, 8. The longitudinal position on the reference line L is thus the same for each blade bar 20 through which the reference line L extends, the respective blade bars 20 being denoted with reference signs 20*a*, 20*b* and 20*c*. From FIG. 3 it can be seen that the first dimension d20*a* of the blade bar 20*a* at the reference line L is larger than the corresponding first dimension d20*b* of the blade bar 20*b*, wherein the blade bar 20*a* is closer to the feed section 23 than the blade bar 20*b* in the circumferential direction of the blade segment 4, 8 at that specific longitudinal or axial X position in the blade segment 4, 8. In a similar way, the first dimension d20*b* of the blade bar 20*b* at the reference line L is larger than the corresponding first dimension d20*c* of the blade bar 20*c*, wherein the blade bar 20*b* is closer to the feed section 23 than the blade bar 20*c* in the circumferential direction of the blade segment 4, 8 at that specific longitudinal or axial X position in the blade segment 4, 8.

For the sake of clarity, the mutual dimensioning of the blade bars 20, 20*a*, 20*b*, 20*c*, or the change in the first dimension of the blade bars 20, 20*a*, 20*b*, 20*c* from one blade to another blade bar is highly exaggerated in FIG. 3.

The embodiment of FIG. 3 discloses a blade segment 4, 8, wherein at the same longitudinal or axial position in the blade segment 4, 8, the first dimension of the blade bars 20 in the circumferential direction of the blade segment 4, 8 is arranged to increase toward the feed section 23 in the circumferential direction of the blade segment 4, 8 such that at the same longitudinal or axial position in the blade segment 4, 8 the first dimension of at least one blade bar 20 in the circumferential direction of the blade segment 4, 8 is larger than the first dimension of at least one another blade bar 20 in the circumferential direction of the blade segment 4, 8, wherein the at least one another blade bar 20 is in the circumferential direction of the blade segment 4, 8 farther away from the feed section 23 than the first mentioned at least one blade bar 20. The direction of an increase in the first dimension of the blade bars 20 in the circumferential direction C of the blade segment 4, 8 is thus toward the feed section 23, as shown schematically by the end of line L comprising the arrowhead pointing toward the feed section 23.

The first dimension d20*a*, d20*b*, d20*c* of the respective blade bar 20*a*, 20*b*, 20*c* shown in FIG. 3 is a width of the respective blade bar 20*a*, 20*b*, 20*c* in the circumferential direction of the blade segment 4, 8. It is noted herein that the first dimension d20*a*, d20*b*, d20*c* is not the actual width w20*a*, w20*b*, w20*c* of the respective blade bar 20*a*, 20*b* 20*c* because the blade bars 20 are arranged at an angle AG relative to the longitudinal or axial direction X of the blade segment 4, 8. In other words, the first dimension d20*a*, d20*b*, d20*c* of the respective blade bar 20*a*, 20*b*, 20*c* in the circumferential direction C of the blade segment 4, 8 is proportional to the actual width w20*a*, w20*b*, w20*c* of the respective blade bar 20*a*, 20*b* 20*c*. The blade bar angle AG is defined as the angle of the blade bars relative to the longitudinal direction X of the blade segment 4, 8. The width of the blade bars 20*a*, 20*b* 20*c* in the longitudinal direction times Sin(AG) provides the actual width w20*a*, w20*b*, w20*c* of the respective blade bars 20*a*, 20*b* 20*c*.

The effect of the blade bar configuration disclosed in FIG. 3 is an increased strength of the blade bars against fracturing which occur due to impacts and hits by foreign matter or contaminants in the pulp mixture and better wear resistance of the blade bars 20, especially of the blade bars 20 that are closest to the feed section 23 in the circumferential direction C of the blade segment 4, 8. This provides a prolonged operational life for the blade segment with satisfactory operational characteristics in view of the refining effect to which the blade bars 20 are subjected by the fiber material to be refined.

In the embodiment of FIG. 3, the first dimension d20*a*, d20*b*, d20*c* of the blade bars 20*a*, 20*b*, 20*c* in the circumferential direction of the blade segment 4, 8 is arranged to increase in the circumferential direction C of the blade segment 4, 8 substantially continuously toward the feed section 23 in such a way that at the same longitudinal X position in the blade segment 4, 8 the first dimension d20*a*, d20*b*, d20*c* of the blade bar 20 being closer to the feed section 23 in the circumferential direction of the blade segment 20 is larger than the first dimension d20*a*, d20*b*, d20*c* of the neighboring blade bar 20 being located farther away from the feed section 23.

According to an embodiment of the blade segment 4, 8, the first dimension of the blade bars 20 in the circumferential direction of the blade segment 4, 8 is arranged to increase in the circumferential direction C of the blade segment 4, 8 stepwise toward the feed section 23. At the same longitudinal position in the blade segment 4, 8 the first dimension of the blade bars 20 in a group of neighboring blade bars 20 is larger in the group of neighboring blade bars 20 closer to the feed section 23 in the circumferential direction of the blade segment 4, 8. Herein the term group of neighboring blade bars 20 refers to two or more immediately adjacent blade bars 20 in the circumferential direction C of the blade segments 4, 8.

According to an embodiment, at the same longitudinal or axial or radial X position in the blade segment 4, 8, in the circumferential direction C of the blade segment 4, 8, an increase in the first dimension of the blade bars 20 between the blade bar 20 located to be the closest to the feed section 23 and the blade bar 20 located to be the farthest away from the feed section 23 is 10-80%, preferably 10-50% or 10-30%.

According to an embodiment, at the same longitudinal or axial or radial X position in the blade segment 4, 8, in the circumferential direction C of the blade segment 4, 8, the width of the blade bar 20 located to be the closest to the feed section 23 is 1-10 mm depending on the fiber type, for short fiber pulp typically from 1-5 mm and 3-7 mm for long fiber pulp. As an example, in low consistency 3-6% refining of short fiber pulp, like eucalyptus-containing pulp, in a refiner with steep 10-30-degree blade bar angle AG the actual width of the blade bar 20 closest to the inner end edge and the leading side edge could be like 1.3 mm while the actual width of the blade bar 20 closest to the inner end edge and the trailing edge would be 1.1 mm, the increase of the actual width being around 20%. The respective widths for long-fiber softwood pulp could be from 6 mm closest to the feed section down to 4 mm closest to the opposite edge, the increase being around 50%.

Figure 4:
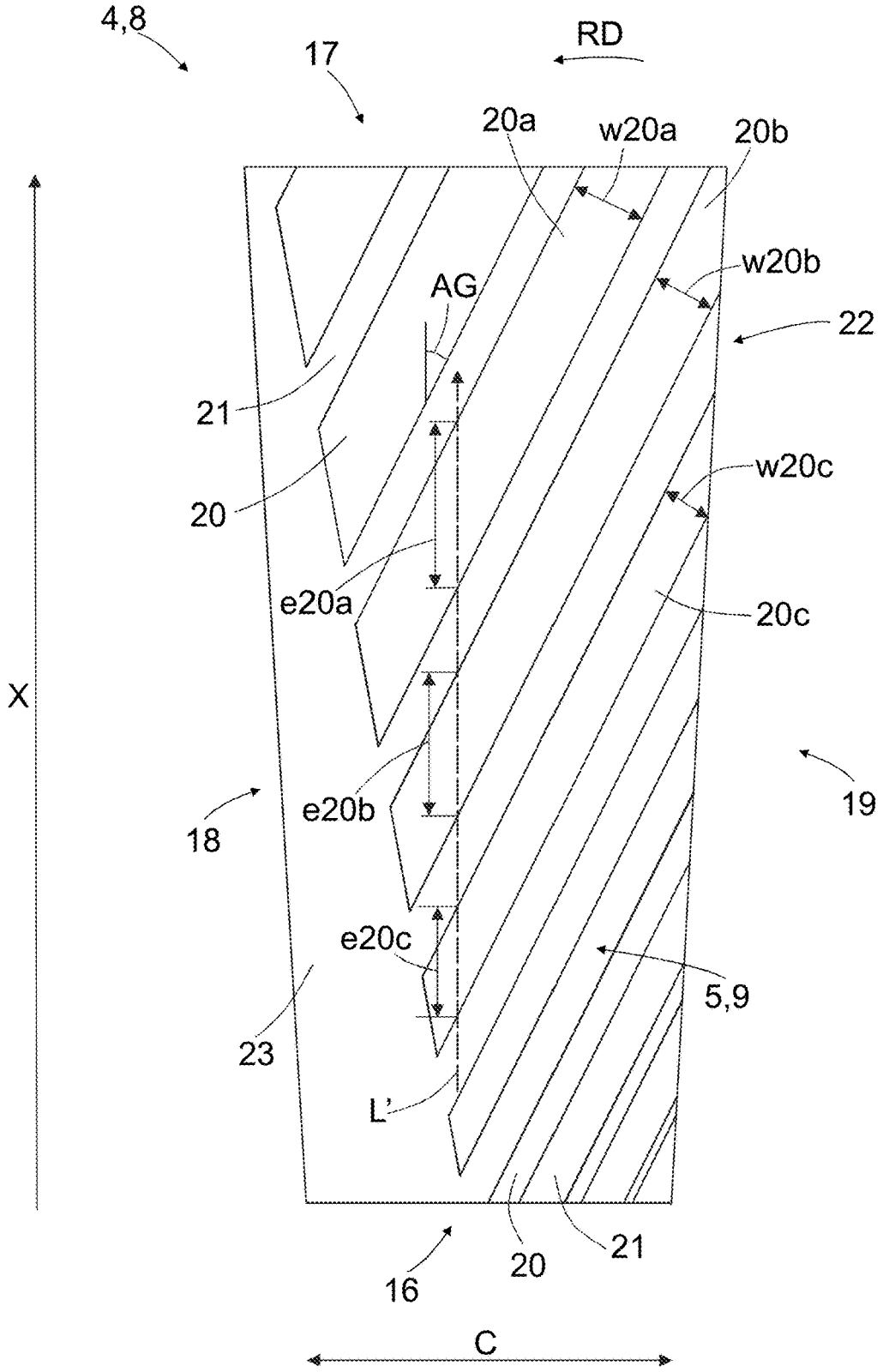

FIG. 4 discloses the same blade segment 4, 8 as FIG. 3. FIG. 3 is thus also a highly schematic planar top view of a blade segment 4, 8 applicable to form a part of a stator 3 or a rotor 6 in the refiner of FIG. 2. The blade segment 4, 8 of FIG. 3 is presented again in FIG. 4 for improving the clarity of presentation of some possible additional embodiments of the blade segment 4, 8 disclosed above and of the reference signs relating especially to these additional embodiments of the blade segment 4, 8.

In FIG. 4 there is a dashed reference line L' running in the longitudinal or axial direction X of the blade segment 4, 8 at a specific circumferential C position, i.e., at a specific position along the transverse axis C of the comminution section 22 in the blade segment 4, 8 from the respective feed section 23 of the blade segment 4, 8. The circumferential C position of the reference line L' is thus the same for each blade bar 20 through which the reference line L' extends, the respective blade bars 20 being denoted herein again with reference signs 20*a*, 20*b* and 20*c*. From the FIG. 4 it can be seen, that the second dimension e20*a* of the blade bar 20*a* at the reference line L' in the longitudinal or axial direction X of the blade segment 4, 8 is larger than the corresponding second dimension e20*b* of the blade bar 20*b*, wherein the blade bar 20*a* remains closer to the outer end edge 17 than the blade bar 20*b* in the longitudinal or axial direction X of the blade segment 4, 8 at that specific circumferential C position in the blade segment 4, 8. In a similar way, the second dimension e20*b* of the blade bar 20*b* at the reference line L' in the longitudinal direction X of the blade segment 4, 8 is larger than the corresponding second dimension e20*c* of the blade bar 20*c*, wherein the blade bar 20*b* remains closer to the outer end edge 17 than the blade bar 20*c* in the longitudinal direction X of the blade segment 4, 8 at that specific circumferential C position in the blade segment 4, 8.

Again herein, for the sake of clarity, the mutual dimensioning of the blade bars 20, 20*a*, 20*b*, 20*c*, or the change in the second dimension of the blade bars 20, 20*a*, 20*b*, 20*c* from one blade bar to another blade bar shown is highly exaggerated in FIG. 4.

The embodiment of FIG. 4 thus discloses a blade segment 4, 8, wherein at the same circumferential position in the blade segment 4, 8, the second dimension of the blade bars 20 in the longitudinal direction X of the blade segment 4, 8 is arranged to increase toward the outer end edge 17 of the blade segment 4, 8 in the longitudinal direction of the blade segment 4, 8 such that at the same circumferential position in the blade segment 4, 8 the second dimension of at least one blade bar 20 is larger than the second dimension of at least one another blade bar. 20, wherein the at least one another blade bar 20 is in the longitudinal direction of the blade segment 4, 8 farther away from the outer end edge 17 of the blade segment 4, 8, i.e., closer to the inner end edge 16 of the blade segment 4, 8, than the first mentioned at least one blade bar 20. The direction of an increase in the second dimension of the blade bars 20 in the longitudinal direction X of the blade segment 4, 8 is thus toward the outer end edge 17 of the blade segment 4, 8, i.e., takes place in the longitudinal direction X of the blade segment, as shown schematically by the end of line L' comprising the arrowhead pointing toward the outer end edge of the blade segment 4, 8.

The second dimension e20*a*, e20*b*, e20*c* of the respective blade bar 20*a*, 20*b*, 20*c* shown in FIG. 4 is a width of the respective blade bar 20*a*, 20*b*, 20*c* in the longitudinal direction X of the blade segment 4, 8. It is noted herein that the second dimension e20*a*, e20*b*, e20*c* is not the actual width w20*a*, w20*b*, w20*c* of the respective blade bar 20*a*, 20*b* 20*c* because the blade bars 20 are arranged at an angle AG relative to the longitudinal direction X of the blade segment 4, 8. In other words, the second dimension e20*a*, e20*b*, e20*c* of the respective blade bar 20*a*, 20*b*, 20*c* in the longitudinal direction X of the blade segment 4, 8 is proportional to the actual width w20*a*, w20*b*, w20*c* of the respective blade bar 20*a*, 20*b* 20*c* and the blade bar angle AG relative to the longitudinal direction X of the blade segment 4, 8. The significance of the blade bar angle AG for the second dimension is remarkably bigger than for the first dimension since the blade bar angle is typically clearly less than 45 degrees.

The effect of the blade bar configuration disclosed in FIG. 4 is an increased wear resistance of the blade bars 20, especially of the blade bars 20 that are close to the outer end edge 17 of the blade segment, in the longitudinal direction X of the blade segment 4, 8. There is an increased wear rate which affects the blade bars that are substantially close to the outer end edge 17 of the blade segment 4, 8. This increased wear rate originates from the higher circumferential speed taking place at an outer periphery of the blade segment, because shearing forces, which affect the wear rate of the blade bars, are dependent on the circumferential speed. With the embodiment of FIG. 4 the blade bars 20 at the outer edge are, because they are wider, better able to resist this wear thus the refining gap between the blade segment 4, 8 is maintained constant up to the outer edge 17. The embodiment of FIG. 4 provides a further prolonged operational life for the blade segment with satisfactory operational characteristics in view of the refining effect to which the fiber material to be refined is subjected.

In the embodiment of FIG. 4, the second dimension e20*a*, e20*b*, e20*c* of the bars 20*a*, 20*b*, 20*c* in the longitudinal or axial direction X of the blade segment 4, 8 is arranged to increase in the longitudinal direction X of the blade segment 4, 8 substantially continuously toward the outer end edge 17 of the blade segment 4, 8 in such a way that at the same circumferential C position in the blade segment 4, 8 the second dimension e20*a*, e20*b*, e20*c* of the blade bar 20 being closer to the outer end edge 17 in the longitudinal direction X of the blade segment 4, 8 is larger than the second dimension e20*a*, e20*b*, e20*c* of the blade bar 20 being located farther away from the outer end edge 17.

According to an embodiment of the blade segment 4, 8, the second dimension of the blade bars 20 in the longitudinal or axial direction X of the blade segment 4, 8 is arranged to increase in the longitudinal direction X of the blade segment 4, 8 stepwise toward the outer end edge 17 in such a way that at the same circumferential C position in the blade segment 4, 8 the second dimension of the blade bars 20 in a group of neighboring blade bars 20 is larger in the group of neighboring blade bars 20 closer to the outer end edge 17 in the longitudinal direction X of the blade segment 4, 8. Herein the term group of neighboring blade bars 20 refers to two or more immediately adjacent blade bars 20 in the longitudinal direction X of the blade segments 4, 8.

According to an embodiment, at the same circumferential C position in the blade segment 4, 8 in the longitudinal or axial direction X of the blade segment 4, 8, there is an increase in the second dimension of the blade bars 20 located farthest away from the inner end edge 16 is 10-100%, preferably 10-50% compared to the blade bar 20 located closest to the inner end edge 16.

In the embodiment of FIGS. 3 and 4 each blade bar 20 has a constant width along its length but the design principle disclosed above may also be applied with blade bars whose width is arranged either to increase or decrease along their length.

According to an embodiment the comminution device 1 is a disperser for dispersing fiber material, whereby the fiber material may be recycled fiber material. In dispersing a dispersing effect is applied to the fiber material to be processed for disintegrating contaminants in the fiber material to diminish negative effects of the contaminants in the further use of the dispersed fiber material or to facilitate a removal of the contaminants. When the comminution device 1 is a disperser, the comminution elements 3, 6, i.e., the stator 3 and the rotor 6, are implemented as dispersing elements of the disperser, and the comminution surfaces 5, 9 of the comminution elements 3, 6 are implemented as dispersing surfaces of the dispersing elements. The dispersing surfaces of the dispersing elements comprise projecting parts or bars, and clearances or grooves therebetween. The projecting parts form in the dispersing surface the comminution parts arranged to apply a dispersing effect to the fiber material to be processed. The projecting part has typically a structure with substantially small length and width, the length of the projecting part typically not being substantially greater than the width of the projecting part. The shape of the projecting part may, however, vary in many ways, including for example various kind of polygons or pyramids etc. The clearances are free spaces or interstices remaining between the projecting parts for providing flow channels for the flow of the fiber material to be processed along the dispersing surfaces. In a dispersing surface of a disperser a distance between adjacent projecting parts is typically much greater than a distance between adjacent blade grooves, i.e., a width of the blade grooves in a refining surface of a refiner.

Figure 5:
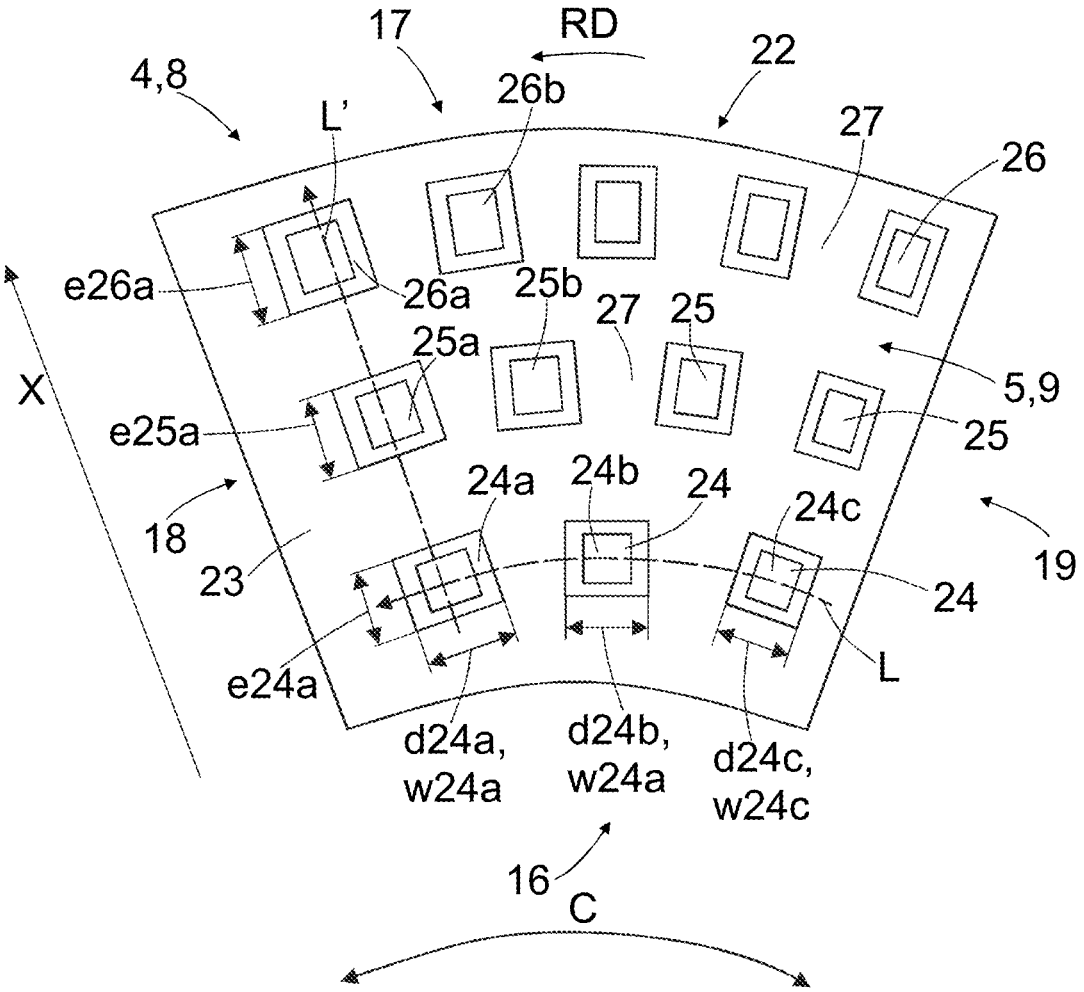
FIG. 5 is a schematic top view of a blade element of a disperser.

FIG. 5 is a highly schematic planar top view of a blade segment 4, 8 applicable to form a part of a stator 3 or a rotor 6 in a disc-like disperser. The basic construction of the blade segment 4, 8 of FIG. 5 is similar to that of FIG. 3, the major difference being that the blade segment 4, 8 of FIG. 5 is intended to a disc-like comminution element whereas the blade segment 4, 8 of FIG. 3 is intended to a conical comminution element.

The blade segment 4, 8 comprises the dispersing surface 5, 9 comprising projecting parts 24, 25, 26 or teeth 24, 25, 26 and clearances 27 between the projecting parts 24, 25, 26. The projecting parts 24, 25, 26 are arranged at circumferentially extending rows positioned at different positions in the longitudinal direction X of the blade segment 4, 8 from the inner end edge 16 of the blade segment 4, 8, each row having a suitable number of the respective projecting parts

24, 25, 26. The projecting parts 24, 25, 26 and the clearances 27 have a first dimension in the circumferential direction C of the blade segment 4, 8 and a second dimension in the longitudinal direction X of the blade segment 4, 8. The first dimension of the projecting parts 24, 25, 26 is thus a circumferential dimension of the projecting parts 24, 25, 26 and the second dimension of the projecting parts 24, 25, 26 is thus the dimension of the projecting parts 24, 25, 26 along the longitudinal axis X of the blade segment. A section of the dispersing surface 5, 9 of the blade segment 4, 8 comprising the projecting parts 24, 25, 26 and the clearances 27 forms a dispersing section 22, i.e., a comminution section 22, of the blade segment 4, 8. The section of the dispersing surface 5, 9 of the blade segment 4, 8 being substantially free from the projecting parts 24, 25, 26 forms a feed section 23 of the blade segment 4, 8. The feed section 23 extends from the inner end edge 16 of the blade segment 4, 8 toward an outer end edge 17 of the blade segment 4, 8, and may extend up to the outer end edge 17 as schematically shown in FIG. 5. The fiber material to be processed enters to the feed section 23 over the inner end edge 16 of the blade segment 4, 8 and the fiber material further flows from the feed section 23 to the dispersing section 22 in response to the rotation of the rotor 6. A single blade segment 4, 8 may comprise one or more dispersing sections 22 and one or more feed sections 23.

For resisting excessive wear of the projecting parts 24, 25, 26 especially at a position next or close to the feed section 23 so as to prolong an operating life of the blade segment 4, 8 with a satisfactory operational efficiency, it is shown in FIG. 5 an embodiment, wherein at the same longitudinal or radial X position in the blade segment 4, 8 the first dimension d24*a*, d24*b*, d24*c* of the projecting parts 24 is arranged to be larger in the projecting parts 24 remaining closer to the feed section 23 than in the projecting parts 24 remaining farther away from the feed section 23 in the circumferential direction C of the blade segment 4, 8. The same characteristic is also applied for the dimensioning of the projecting parts 25, 26. Thus, the first teeth 24*a*, 25*a*, 26*a* closest to the leading edge 18 are wider than the next teeth 24*b*, 25*b*, 26*b* toward the trailing edge 19.

For resisting excessive wear of the projecting parts 24, 25, 26 especially at a position next or close to the outer end edge 17 of the blade segment 4, 8 to further prolong an operating life of the blade segment 4, 8, it is also shown in FIG. 5 an embodiment, wherein at the same circumferential C position in the blade segment 4, 8 the second dimension e24*a*, e25*a*, e26*a* of the projecting parts 24, 25, 26 is arranged to be larger in the projecting parts 26 remaining closer to the outer end edge 17 than in the projecting parts 25, and similarly in the projecting parts 25 remaining closer to the outer end edge 17 than in the projecting parts 24 remaining farther away from the outer end edge 17 in the longitudinal direction X of the blade segment 4, 8.

The discussion relating to the dimensioning of the blade bars 20 in connection with the embodiment of FIG. 3 and FIG. 4 above is applicable and self-evident for the person skilled in the art also for the dimensioning of the projecting parts 24, 25, 26 in this embodiment of FIG. 5 by replacing the term "blade bar" with the term "projecting part", including also a possible angle between the longitudinal direction X of the blade segment 4, 8 and the applied orientation of the projecting part 24, 25, 26 in the dispersing surface 5, 9. The applied orientation of the projecting parts 24, 25, 26 relative to the longitudinal or radial direction X of the blade segment 4, 8 may cause that the first dimensions of the projecting parts 24, 25, 26 in the circumferential direction C of the blade segment 4, 8 and the second dimensions of the projecting parts 24, 25, 26 in the longitudinal or radial direction X of the blade segment 4, 8 may differ from the actual dimensions of the projecting parts 24, 25, 26 considered to present a width or length of the projecting part 24, 25, 26.

It will be obvious to a person skilled in the art that, as the technology advances, the inventive concept can be implemented in various ways. The invention and its embodiments are not limited to the examples described above but may vary within the scope of the claims.

We claim:

1. A blade element for a comminution device which comminutes fiber material, the comminution device having a rotor which rotates in a circumferential direction opposite at least one of a stator or a second rotor, wherein a longitudinal direction is defined perpendicular to the circumferential direction, the comminution device having a feed channel and a discharge chamber, the blade element comprising:

portions of the blade element defining an inner end edge over which fiber material to be processed enters, and an outer end edge over which processed fiber material leaves the blade element;

portions of the blade element defining a leading edge and a trailing edge so that fiber material passes from the leading edge toward the trailing edge;

wherein the blade element has at least one comminution section between the leading edge and the trailing edge and between the inner end edge and the outer end edge, the at least one comminution section having a plurality of protruding comminution parts wherein the blade element defines free spaces between the plurality of comminution parts for providing flow channels for the flow of fiber material to be processed;

wherein each comminution part has a first dimension extending in the circumferential direction of the blade element and a second dimension extending in the longitudinal direction of the blade element, and the blade element has at least one feed section extending in the longitudinal direction of the blade element, each feed section arranged to feed fiber material to the comminution section;

wherein at a selected longitudinal position on the blade element the first dimension of the comminution parts increase in the circumferential direction of the blade element toward the feed section;

at a selected circumferential position on the blade element the second dimension of the comminution parts increase in the longitudinal direction of the blade element toward the outer end edge such that the second dimension of at least one comminution part is larger than the corresponding second dimension of at least one other comminution part that is farther away from the outer end edge in the longitudinal direction of the blade element.

2. The blade element of claim 1 wherein the first dimension of the comminution parts is arranged to increase substantially continuously toward the feed section in such a way that the first dimension of the comminution part being closer to the feed section in the circumferential direction of the blade element is larger than the first dimension of the comminution part being located farther away from the feed section.

3. The blade element of claim 1 wherein the first dimension of the comminution parts increases stepwise toward the feed section in such a way that the first dimension of the comminution parts in a group of neighbouring comminution parts is equal but the first dimension of the comminution parts is larger in a group of neighbouring comminution parts being closer to the feed section in the circumferential direction of the blade element.

4. The blade element of claim 1 wherein the feed section extends along a side of the blade element from the inner end edge to the outer end edge, the feed section being wider at the inner end edge of the blade element than at the outer end edge of the blade element, and wherein the comminution parts are arranged at an acute angle to a radial line which extends from the inner end edge to the outer end edge and each comminution part has a center line and has a width perpendicular to its center line, such that the width of the comminution parts positioned closer to the outer end edge are wider than the comminution parts which are closer to the inner end edge.

5. The blade element of claim 1 wherein at the same longitudinal position in the blade element an increase in the first dimension of the comminution parts between the comminution part located to be the closest to the feed section and the comminution part located to be the farthest away from the feed section is 10-80%.

6. The blade element of claim 5 wherein at the same longitudinal position in the blade element an increase in the first dimension of the comminution parts between the comminution part located to be the closest to the feed section and the comminution part located to be the farthest away from the feed section is 10-50%.

7. The blade element of claim 1 wherein the second dimension of the comminution parts increases substantially continuously toward the outer end edge of the blade element in such a way that the second dimension of the comminution part being closer to the outer end edge in the longitudinal direction of the blade element is larger than the second dimension of the comminution part being located farther away from the outer end edge.

8. The blade element of claim 1 wherein the second dimension of the comminution parts increases stepwise toward the outer end edge in such a way that the second dimension of the comminution parts in a group of neighbouring comminution parts is equal but the second dimension of the comminution parts is larger in a group of neighbouring comminution parts being closer to the outer end edge.

9. The blade element of claim 1 wherein an increase in the second dimension of the comminution parts between the comminution part located to be the closest to the inner end edge and the comminution part located to be the farthest away from the inner end edge is 10-100%.

10. The blade element of claim 9 wherein an increase in the second dimension of the comminution parts between the comminution part located to be the closest to the inner end edge and the comminution part located to be the farthest away from the inner end edge is 10-50%.

11. The blade element of claim 1 further comprising:

a rotor to which the blade element is fixed; and a frame on which the rotor is supported for rotatable motion with respect to a stator or a second rotor, to form a refiner for refining fiber material.

12. The blade element of claim 1 further comprising:

a rotor to which the blade element is fixed; and a frame on which the rotor is supported for rotatable motion with respect to a stator or a second rotor, to form a disperser for dispersing fiber material.

13. A blade element for a refiner for refining fiber material or a disperser for dispersing fiber material, the refiner or disperser having a rotor which rotates in a circumferential direction opposite at least one of a stator or a second rotor, wherein a longitudinal direction is defined perpendicular to the circumferential direction, the refiner or disperser having a feed channel and a discharge chamber, the blade element comprising:

portions of the blade element defining an inner edge over which fiber material to be processed enters, and an outer edge over which processed fiber material leaves the blade element;

portions of the blade element defining a leading edge and a trailing edge so that fiber material passes from the leading edge toward the trailing edge;

wherein the blade element has a comminution section between the leading edge and the trailing edge and between the inner edge and the outer edge, the comminution section having a plurality of protruding bars with free spaces therebetween defining flow channels for the flow of the fiber material to be processed along a comminution surface defined by the plurality of bars within the comminution section;

wherein the blade element has a feed section extending in the longitudinal direction of the blade element, the feed section arranged to feed fiber material to the refining section and being without blade bars;

wherein the feed section extends along a side of the blade element from the inner edge to the outer edge, the feed section being wider at the inner edge of the blade element than at the outer edge of the blade element, and wherein the blade bars are arranged at an acute angle to a radial line which extends from the inner edge to the outer edge and each blade bar has a center line and has a width perpendicular to its center line, such that the width of the blade bars positioned closer to the leading edge are wider than the blade bars which are farther from the leading edge.

14. The blade element of claim 13 wherein the comminution section comprises at least two first neighboring bars of the same width, and at least two second neighboring bars located toward the leading edge from the at least two first neighboring bars, and the second neighboring bars have the same width which is greater than the width of the two first neighboring bars.

15. The blade element of claim 13, wherein one of the bars comprises a first bar which is positioned closet to the leading edge, and wherein the comminution section further comprises a plurality of bars positioned away from the leading edge, and wherein each of the plurality of bars has a width which is less than the width of the neighboring bar which is closer to the first bar.

16. The blade element of claim 13 further comprising:

a rotor to which the blade element is fixed; and a frame on which the rotor is supported for rotatable motion with respect to a stator or a second rotor, to form a refiner for refining fiber material or a disperser for dispersing fiber material.

17. A blade element forming at least part of a disk for a comminution device which comminutes fiber material, the comminution device having a rotor which rotates in a circumferential direction opposite at least one of a stator or a second rotor, wherein a longitudinal direction is defined perpendicular to the circumferential direction, the comminution device having a feed channel and a discharge chamber, the blade element comprising:

portions of the blade element defining a feed section from an inner edge over which fiber material to be processed enters, and extending toward an outer edge over which processed fiber material leaves the blade element;

portions of the blade element defining a leading edge over which fiber material is arranged to be driven by rotation in the circumferential direction and a trailing edge opposite the leading edge;

wherein the blade element has at least one comminution section between the leading edge and the trailing edge and between the inner edge and the outer edge, the at least one comminution section having a plurality of projecting teeth, and wherein the blade element has portions defining free spaces between the plurality of projecting teeth for providing flow channels for the fiber material to be processed to flow;

wherein the plurality of projecting teeth are arranged spaced apart from each other in circumferentially extending rows positioned at different positions in the longitudinal direction of the blade segment from the inner edge toward the outer edge wherein each row has multiple spaced projecting teeth of the plurality of projecting teeth similarly spaced;

wherein each of the plurality of projecting teeth has a first dimension extending in the circumferential direction of the blade element and a second dimension extending in the longitudinal direction of the blade element;

wherein the blade element feed section extends along the leading edge in the longitudinal direction of the blade element, the feed section arranged to be free of projecting teeth and arranged to feed fiber material to the at least one comminution section;

wherein in each circumferentially extending row the projecting teeth closest to the feed section have a greater width in the circumferential direction than the projecting teeth in the same row further from the feed section; and wherein the tooth closest to the feed section and to the outer edge has the greatest length in the longitudinal direction.

18. A blade element forming at least part of a disk for a comminution device which comminutes fiber material, the comminution device having a rotor which rotates in a circumferential direction opposite at least one of a stator or a second rotor, wherein a longitudinal direction is defined perpendicular to the circumferential direction, the comminution device having a feed channel and a discharge chamber, the blade element comprising:

portions of the blade element defining a feed section from an inner edge over which fiber material to be processed enters, and extending toward an outer edge over which processed fiber material leaves the blade element;

portions of the blade element defining a leading edge over which fiber material is arranged to be driven by rotation in the circumferential direction and a trailing edge opposite the leading edge;

wherein the blade element has at least one comminution section between the leading edge and the trailing edge and between the inner edge and the outer edge, the at least one comminution section having a plurality of projecting teeth, and wherein the blade element has portions defining free spaces between the plurality of projecting teeth for providing flow channels for the fiber material to be processed to flow;

wherein the plurality of projecting teeth are arranged spaced apart from each other in circumferentially extending rows positioned at different positions in the longitudinal direction of the blade segment from the inner edge toward the outer edge wherein each row has multiple spaced projecting teeth of the plurality of projecting teeth similarly spaced;

wherein each of the plurality of projecting teeth has a first dimension extending in the circumferential direction of the blade element and a second dimension extending in the longitudinal direction of the blade element;

wherein the blade element feed section extends along the leading edge in the longitudinal direction of the blade element, the feed section arranged to be free of projecting teeth and arranged to feed fiber material to the at least one comminution section;

wherein in each circumferentially extending row the projecting teeth closest to the feed section have a greater width in the circumferential direction than the projecting teeth in the same row further from the feed section; and wherein in each circumferentially extending row the projecting teeth increase in width in the circumferential direction of the blade element toward the feed section.

19. The blade element of claim 17 further comprising:

a rotor to which the blade element is fixed; and a frame on which the rotor is supported for rotatable motion with respect to a stator or a second rotor, to form a disperser for dispersing fiber material.

20. The blade element of claim 18 further comprising:

a rotor to which the blade element is fixed; and a frame on which the rotor is supported for rotatable motion with respect to a stator or a second rotor, to form a disperser for dispersing fiber material.

* * * * *